US008783079B2

(12) United States Patent
Behrens et al.

(10) Patent No.: US 8,783,079 B2
(45) Date of Patent: Jul. 22, 2014

(54) DEVICE AND NON-CUTTING SHAPING METHOD FOR INTRODUCING AN OUTSIDE PROFILE INTO A WORKPIECE

(75) Inventors: Bernd-Arno Behrens, Harsum (DE); Hagen Schmidt, Hannover (DE); Philipp Silberkuhl, Hannover (DE); Dietmar Schnier, Garbsen (DE)

(73) Assignee: Gottfried Wilhelm Leibniz Universitaet Hannover, Hannover (DE)

( * ) Notice: Subject to any disclaimer, the term of this patent is extended or adjusted under 35 U.S.C. 154(b) by 360 days.

(21) Appl. No.: 12/988,270

(22) PCT Filed: Mar. 3, 2009

(86) PCT No.: PCT/DE2009/000285

§ 371 (c)(1),
(2), (4) Date: Dec. 29, 2010

(87) PCT Pub. No.: WO2009/127178

PCT Pub. Date: Oct. 22, 2009

(65) Prior Publication Data

US 2011/0107806 A1 May 12, 2011

(30) Foreign Application Priority Data

Apr. 17, 2008 (DE) ..... 10 2008 019 437

(51) Int. Cl.

| | |
|---|---|
| ***B21D 3/02*** | (2006.01) |
| ***B21D 17/00*** | (2006.01) |
| ***B21H 3/02*** | (2006.01) |
| ***B21H 3/04*** | (2006.01) |
| ***B21H 7/18*** | (2006.01) |

(52) U.S. Cl.

CPC .. *B21H 3/02* (2013.01); *B21H 3/04* (2013.01); *B21H 7/187* (2013.01)

USPC ..... 72/102; 72/115; 72/211; 72/469; 29/281.1; 269/43

(58) Field of Classification Search

CPC ..... B21H 3/02; B21H 3/04; B21H 3/042; B21H 3/044; B21H 3/046; B21H 3/048; B21H 7/187; B21H 8/00; B21D 13/04; B23B 27/24

USPC ..... 72/82, 102–106, 115, 207, 454, 455, 72/469, 703, 211, 252.5; 29/43, 45, 246, 29/281.1, 280, 270, 281.3; 269/43, 45, 269/246

See application file for complete search history.

(56) References Cited

U.S. PATENT DOCUMENTS

| | | | | |
|---|---|---|---|---|
| 344,754 | A | 6/1886 | Stetson | |
| 980,197 | A | 1/1911 | Campbell | |
| 981,624 | A | 1/1911 | Dreier | |
| 1,085,643 | A | 2/1914 | Tewksbury | |
| 1,414,668 | A * | 5/1922 | Reed | 72/703 |
| 1,754,489 | A | 4/1930 | Stevenson | |
| 1,983,922 | A | 12/1934 | Ruppel | |
| 2,218,574 | A * | 10/1940 | Gould | 72/104 |
| 2,349,862 | A | 5/1944 | Hallberg | |
| 2,669,139 | A * | 2/1954 | Finch | 72/104 |
| 2,798,390 | A | 7/1957 | Bennett | |
| 3,299,680 | A * | 1/1967 | Thompson | 72/102 |
| 3,793,659 | A | 2/1974 | Edgar | |
| 4,150,450 | A | 4/1979 | Laub, Jr. et al. | |
| 4,426,869 | A | 1/1984 | Farmer et al. | |
| 4,459,839 | A * | 7/1984 | Cochran et al. | 72/454 |
| 4,942,752 | A | 7/1990 | Helfman | |
| 2008/0012015 | A1 | 1/2008 | Shim et al. | |

FOREIGN PATENT DOCUMENTS

| | | | |
|---|---|---|---|
| CN | 2558479 | Y | 7/2003 |
| DE | 102 265 | A | 4/1899 |
| DE | 77 38 892 | U1 | 5/1978 |
| DE | 32 45 266 | A1 | 12/1983 |
| DE | 295 13 910 | U1 | 11/1995 |
| DE | 19831214 | C2 | 7/2003 |
| DE | 699 13 633 | T2 | 11/2004 |
| DE | 102008017076 | B3 | 9/2009 |
| GB | 831644 | A | 3/1960 |
| JP | 48030491 | U | 4/1973 |

| | | | |
|---|---|---|---|
| JP | 2005324202 | A | 11/2005 |
| WO | WO 97/32056 | A1 | 9/1997 |
| WO | WO 01/68288 | A1 | 9/2001 |

OTHER PUBLICATIONS

Afzaal et al. "Metal organic-chemical vapor deposition of β-$In_2S_3$ thin films using a single-source approach" Journal of Materials Science: Materials in Electronics 14 (2003) pp. 555-557.
Allsop et al. "Indium sulfide thin films deposited by the spray on layer gas reaction technique" Thin Solid Films 513 (2006) pp. 52-56.
Asikainen et al. "Growth of In2S3, thin films by atomic layer epitaxy" Applied Surface Science 82/83 (1994) pp. 122-125.
Barone et al. "Deposition of tin sulfide thin films from thin(IV) thiolate precursors" J. Mater. Chem., (2001) 11, pp. 464-468.
Diehl et al. "Vapour Growth of Three In,S, Modifications by Iodine Transport" Journal of Crystal Growth 28 ( 1975) pp. 306-310 North-Holland Publishing Co.
Ernits et al. "Characterisation of ultrasonically sprayed $In_xS_y$ buffer layers for Cu(In,Ga)$Se_2$ solar cells" Thin Solid Films 515 (2007) pp. 6051-6054.
Hehemann et al. "Synthesis, characterization and decomposition studies of tris(N,N-dibenzyldithiocarbamato)indium(III): chemical spray deposition of polycrystalline CuInS2 on copper films" Materials Science and Engineering B 116 (2005) pp. 381-389.
Molloy et al. "New Precursors for the Chemical Vapour Deposition of Tin Sulphide Semiconductors and Related Materials" Joint Review Report:GR/L56442/01 and GR/L54721/01 (2001).
Naghav et al. "High-Efficiency Copper Indium Gallium Diselenide (CIGS) Solar Cells with Indium Sulfide Buffer Layers Deposited by Atomic Layer Chemical Vapor Deposition (ALCVD)" Prog. Photovolt: Res. Appl. (2003); 11 pp. 437-443.
Obrien et al.; "Novel precursors for the growth of α-$In_2S_3$: trisdialkyldithiocarbamates of indium" Thin Solid Films 315 (1988) pp. 57-61.
Parkin et al. "The first single source deposition of tin sulfide coatings on glass: aerosol-assisted chemical vapour deposition using [$Sn(SCH_2CH_2S)_2$]" J. Mater. Chem., (2001), 11, pp. 1486-1490.
Sawada et al. "Highly-conducting indium—tin—oxide transparent films fabricated by spray CVD using ethanol solution of indium (III) chloride and tin (II) chloride" Thin Solid Films 409 (2002) pp. 46-50.
Spiering et al.; "CD-Free Cu(In,Ga)$Se_2$ thin-film solar modules with $In_2S_3$ buffer layer by ALCVD" Thin Solid Films 431-432 (2003) pp. 359-363.
Takahashi et al. "Growth of InN at High Temperature by Halide Vapor Phase Epitaxy" Jpn. J. Appl. Phys. vol. 36 (1997) pp. L743-L745.

* cited by examiner

*Primary Examiner* — Teresa M Ekiert
(74) *Attorney, Agent, or Firm* — Leydig, Voit & Mayer, Ltd.

(57) ABSTRACT

A portable handheld device for introducing an external profile into a longitudinal workpiece by noncutting shaping includes a locking element and a profiling tool having a pitchless profile disposed opposite the locking element and disposable at an adjustable angle as a function of a desired lead angle of the external profile within a force transmission plane, wherein the workpiece is disposable and removable between the profiling tool and the locking element, and wherein the profile tool and the locking element are configured to execute a feed movement relative to one another and to be adjustable to a neutral position.

10 Claims, 3 Drawing Sheets

DEVICE AND NON-CUTTING SHAPING METHOD FOR INTRODUCING AN OUTSIDE PROFILE INTO A WORKPIECE

CROSS REFERENCE TO PRIOR APPLICATIONS

This application is a U.S. National Phase Application under 35 U.S.C. §371 of International Application No. PCT/DE2009/000285, filed Mar. 3, 2009, which claims priority to German Application No. DE 10 2008 019 437.9, filed Apr. 17, 2008. The International Application was published in German on Oct. 22, 2009 as WO 2009/127178 under PCT Article 21 (2).

FIELD

The present invention relates to a device having at least one profiling tool having an external profile, for introducing an external profile, in particular an external thread, into a workpiece having a circular cross-sectional area, by noncutting shaping, in particular, milling or rolling. In addition, the present invention relates to a noncutting shaping method for introducing an external profile into a workpiece by using such a device.

BACKGROUND

The rolling of external profiles refers to the noncutting production of external profiles by cold forming, where the profile is milled into the surface of the corresponding blank.

The shaping process is based on the generation of compressive strains by one or more tools that reproduce shapes on the workpiece.

The advantages over a machine-cutting production reside most notably in the greater fatigue strength that is obtained due to the uninterrupted grain-flow pattern and, at the same time, in an achievable surface hardening.

In contrast to cutting processes, the grain boundaries are not interrupted; moreover, the notch sensitivity is reduced, as is the friction due to the smoother surface.

Thread rolling is mainly used in the industrial production of screws and threaded spindles or bolts. An external profile can be milled using cylindrical thread-rolling dies in radial or through-feed rolling processes.

Cold-forming processes are used in practice to produce large lot sizes in the manufacturing of standardized nuts and screws.

In thread rolling processes using flat thread-rolling dies, the set of dies is provided with the thread mating profile having the lead angle of the thread, one die being fixed and the other movable. The workpiece is then rolled between the flat dies.

Thread rolling using cylindrical thread-rolling dies can be carried out in radial or through-feed rolling processes. In radial rolling processes, the workpiece is held by a straightedge and, in through-feed rolling processes, it is clamped between points. In radial rolling processes, the rolls have a mating profile which has the same lead angle as the rolled thread. The axes of rotation of the workpiece and of the tools must extend in parallel to one another. Each roll pair can only be used for one specific thread.

In through-feed rolling processes, the profiling tools have mutually adjacent, pitchless thread profiles. They are tilted by the requisite lead angle about the horizontal longitudinal axis. They can also be used to a limited extent for smaller workpiece diameters.

The German Utility Model Patent 77 38 892 U1 describes a device for producing threads on workpieces, in particular pipes. The device has a frame, whose mutually parallel longitudinal parts are designed in the form of a slide rail, and has a sliding carriage that is slideable on these longitudinal parts and that has a motor attached thereto. In addition, the device has a clamping device for clamping the workpiece coaxially to the axis of the rolling head. In this context, a plurality of elongated ribs are provided, which, on one edge, each have a working profile that is used for machining a blank of a fastening device, a thread being produced on the blank by rolling. The ribs are configured side-by-side and are fixed to one another, the working profile for forming a tool being configured on the same side.

In addition, the International Patent Application WO 01/68288 A1 also already describes a thread rolling device which has two profiling tools adapted for radial infeed.

The German Patent Application DE 32 45 266 A1 discusses a thread rolling attachment adapted for radial infeed, including two die elements, which are each equipped with means for mounting a profiling tool at one end, as well as with a roll that is fastened to the other end. The die elements are swivel-mounted opposite one another on the housing.

In addition, a method, referred to as thread pressing, is also already known for producing round threads in relatively thin sheet metal. In this context, the thread is pressed by two profiled rolls into the workpiece.

The aforementioned devices have in common that they are installations suited for industrial use. Therefore, a mobile on-site use is not possible, particularly when working with stationary devices.

Moreover, without an electrical power supply, the use of such devices is ruled out.

To the extent that it is necessary to introduce threads on-site into pipes or rods, for example, for installation or assembly purposes, thread cutting is carried out in practice exclusively using thread-cutting dies or die stocks.

Thread-cutting dies or die stocks are generally used for manual cutting processes and for threads having low accuracy requirements. In the case of die stocks, no backward rotation is required. The thread-cutting die is used exclusively for cutting external threads and, on the inside, has three or more cutting edges. Between the cutting edges, hollow spaces are incorporated for curling and carrying away the chips that form. The cutting edges are serrated and, geometrically, represent the internal thread.

To cut an external thread, the workpiece must already have the nominal diameter of the desired thread. The workpiece is torsionally fixed on one side by the side, the thread-cutting die is applied and rotated until the desired thread length is achieved.

In addition, hexagonal thread-cutting dies are also known from the related art, which can be moved to inaccessible locations using a box wrench or open-end wrench.

The inherent disadvantage of such mobile thread-cutting devices is, on the one hand, that the thread can only be introduced beginning at one free end.

Thus, it is not possible to introduce a thread into a workpiece that is supported at both ends. On the other hand, chip-forming machining during thread cutting leads to a reduction in material thickness and thus in strength.

The Patent Application DE 699 13 633 T describes a form of a pipe cutter that is designed as a portable handheld device. The pipe cutter is equipped with a cutter roll, as well as with two mutually opposing pressure rolls that form a locking element. A threaded rod, which is mounted in a threaded sleeve, permits a feed movement of the cutter roll relative to the pressure rolls via a handle. Therefore, these are cutting machining processes.

SUMMARY OF THE INVENTION

An aspect of the present invention is to provide a substantially improved device that is suited for mobile use.

It is intended that the device make it possible for external profiles, preferably external threads, to be introduced into workpieces that are held in a fixed position at both ends.

In an embodiment, a suitable method for introducing such an external profile is provided.

In accordance with the present invention, the workpiece is tangentially introducible and removable between the profiling tool and the locking element, the profiling tool having a pitchless profile and being positionable within a force transmission plane opposite the longitudinal axis of the workpiece at an adjustable tilt angle as a function of a desired lead angle of an external profile to be introduced. In this case, the locking element and profiling tool reside in one force transmission plane, so that no bending or tilting moments arise on the workpiece to be machined. As a concomitant phenomenon, this also makes possible the profiling of short, radially accessible workpieces. Thus, for the first time, the present invention makes it possible for an external thread to be manually introduced into a workpiece whose ends are both supported or are inaccessible or, in the case of which, the external thread is merely to be introduced into a specific section between the end regions. At the same time, the advantageous properties of the noncutting shaping can be utilized by the device in accordance with the present invention, making it possible to realize substantially improved properties of the external thread introduced in this manner. In this context, the pitch is realized by a tilting of the tool axis. This makes it possible to roll threads of any given length, whereby the tool design may include only few guide flanks, in order to increase the pressure, respectively reduce the infeed force in this manner. All essentially cold-formable materials, even particularly hard materials are fundamentally suited as workpiece material.

Once an infeed adjustment at a predetermined infeed force is carried out in the working position, the profile is introduced in a surprisingly simple noncutting process by rotating the entire device about the longitudinal axis of the workpiece, the profile geometry to be produced being uniquely predefined by the profiling tool with regard to the profile depth as well as the profile shape. It is virtually impossible for a profile to be canted or imprecisely introduced. It is merely required that the workpiece geometry be a substantially circular cross-sectional area, which can also have a tubular form or be made of a solid material. An electrical power supply is not necessary, so that many diverse applications, such as those which take place under water or in alpine regions, are possible.

One embodiment of the present invention is also achieved in that, on its side facing the profiling tool, the locking element describes an angle of between 35° and 160°. In this manner, the workpiece is held reliably in the desired angular position, the negative wedge shape being able to lock in place any given outer workpiece diameter within a certain size range. Moreover, the locking element may be fixed to the device adjustably or replaceably, for example.

Moreover, it proves to be particularly effective when the locking element form includes a groove, enabling the groove flanks to symmetrically surround the workpiece. The groove flanks preferably form an angle of between 35° and 160°, in particular of between 80° and 140°.

On the other hand, also advantageous is a specific embodiment of the present invention which provides for the locking element to have at least one pressure roll opposing the profiling tool in order to minimize the friction occurring during the rolling process.

In this context, the pressure roll preferably has a cylindrical geometry without a profiling; equally conceivable, however, is a pressure roll designed as a profiling tool, so that the locking element likewise has a profiling. This may engage in the interspaces of the previously introduced external profile, for example, in order to thereby improve the transfer of force by the locking element.

The material selection is made while taking boundary conditions into account, which exclude both brittle as well as very soft materials.

It is useful when the locking element is composed, at least in portions thereof, of a material having a reduced sliding friction resistance, so that the manual actuation of the device entails little expenditure of force, thereby resulting in a reduction of torsional stresses within the workpiece.

The locking element used as a counter support may, for example, have a vapor-deposited coating and may also be hardenable in order to be able to reduce wear or dispense with lubricant.

In this context, the locking element or the pressure roll is made of a low-wear material, at least in the region of one surface area that contacts the workpiece, it being possible for one contact surface of the locking element or the pressure roll to be designed as a replaceable part that is subject to wear.

In principle, the profiling tool may have a mating profile having a lead angle to be introduced into the workpiece. On the other hand, it is advantageous that the profiling tool feature a pitchless profile and that it be positionable within a force transmission plane opposite the longitudinal axis of the workpiece at a tilt angle as a function of a desired lead angle of an external profile to be introduced, in order to thereby permit its use for other workpiece diameters as well.

It is also advantageous that the tilt angle be adjustable to facilitate adaptation to the particular requirements, in particular, to the desired pitch of a profile to be introduced. This makes it possible to implement even individual external or non-standard external profiles.

Moreover, it is recommended that the profiling tool be releasably, in particular, replaceably fixed by a mounting support to the device, in order to permit an effortless replacement of the profiling tool as needed. To this end, the tool is connected to the mounting support, in particular, by a quick fastener.

In this context, the locking element may be displaceably mounted on the device via a guide rail in order to thereby realize the feed movement of the profiling tool relative to the locking element with little expenditure. The locking element is preferably guided non-displaceably in the rail which, at the same time, has a mount designed as a recess for the limit stop, for example. The feed movement could also be accomplished by an eccentric member.

It is self-evident that the profiling tool and the locking element may be designed to execute a feed movement relative to one another, in particular via an electromotive actuator. On the other hand, however, it is especially in line with actual practice when the locking element is advanceable by a threaded rod or threaded spindle that is mounted in a threaded sleeve, in order to thereby achieve a broader adjustment range for introducing and removing various workpieces, while, at the same time, providing a very precise, stepless adjustment capability.

The formation provided on the device to allow initiation of rotary movement thereof about the longitudinal workpiece axis may include an angular recess for a commercial tool, for example, for a torque wrench.

On the other hand, it is simple when the device has at least one specific lever arm having a handle for manually transmitting the rotary motion about the workpiece, enabling the user to easily rotate the device about the longitudinal workpiece axis with little expenditure of force. In this context, two mutually opposing lever arms facilitate the manipulation of the device, for example. It is self-evident that the lever arm may be designed, as required, to be extensible, for example, telescopic.

It is advantageous in this context when, in accordance with a further refinement of the present invention, the threaded rod features an end portion having the handle, so that the threaded rod forms the lever arm for the turning motion of the device. This makes it possible to further reduce the design complexity required for manufacturing the device.

The second-mentioned objective, to devise a suitable method for introducing such an external thread, is achieved in accordance with the present invention by a noncutting shaping method for introducing an external thread into a workpiece using the device, in which case a neutral position is first adjusted in which a locking element is spaced apart from an opposing profiling tool, and the workpiece is introduced radially between the profiling tool and the locking element; the profiling tool and the locking element are subsequently advanced towards each other until the desired infeed force is transmitted to the workpiece, and, finally, the external thread is introduced by a rotary motion of the device about the longitudinal workpiece axis. In this manner, the external thread may be introduced into a workpiece that is inaccessible at both ends.

BRIEF DESCRIPTION OF THE DRAWINGS

The present invention may be embodied in different forms. To further illustrate its basic principle, one embodiment thereof is shown in the drawing and will be described hereinbelow. The figures show.

DETAILED DESCRIPTION

Figure 1:
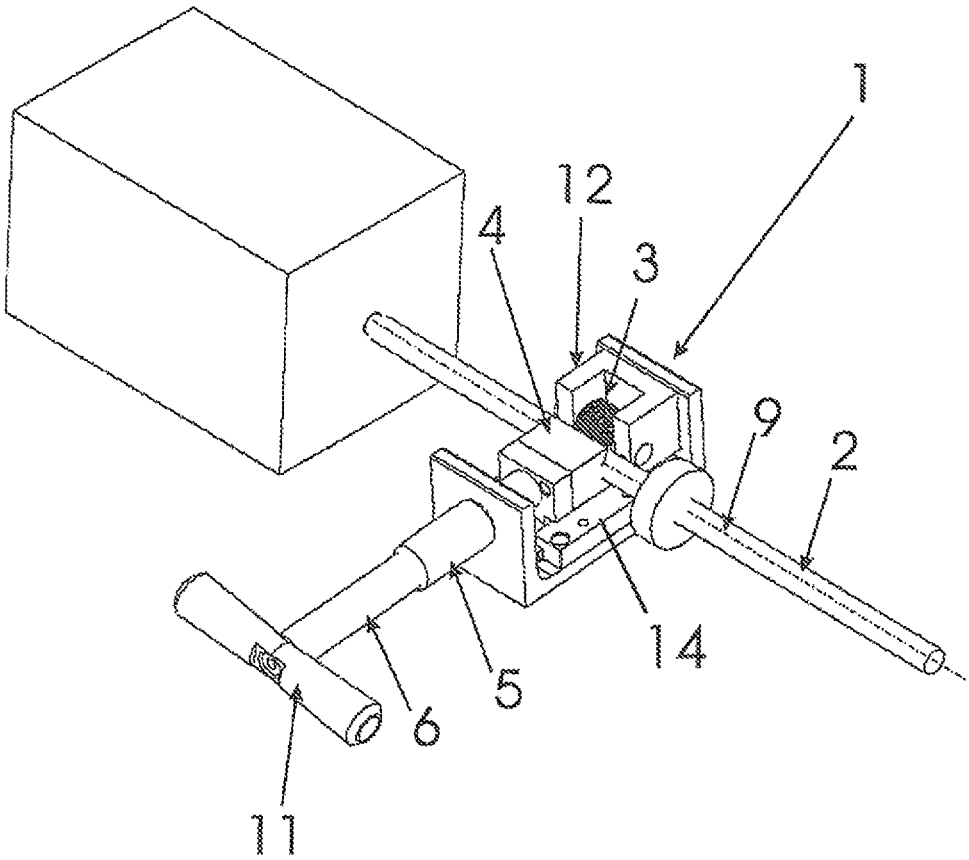
FIG. 1 a device according to the present invention in a neutral position in a perspective view.

Device 1 according to the present invention, which is designed for profile milling or roiling, for the noncutting introduction of an external thread into a workpiece 2, is described in greater detail in the following with reference to FIG. 1 through 3. Device 1 is designed as a portable handheld device, in order to permit an on-site use, in particular, when working with stationary workpieces 2. Facing opposite profiling tool 3 having the profile is a locking element 4, which is advanceable along a guide rail 14 in the direction of profiling tool 3 and which is mounted so as to be displaceable by a threaded rod 6 that is mounted in a threaded sleeve 5. Locking element 4 is made of a low-wear material and has a groove 7 whose groove base 8 extends in parallel to longitudinal axis 9 of workpiece 2. Alternatively, as shown in FIG. 3 in a working position of device 1, locking element 4 may additionally have at least one pressure roll 10 facing opposite profiling tool 3.

Figure 2:
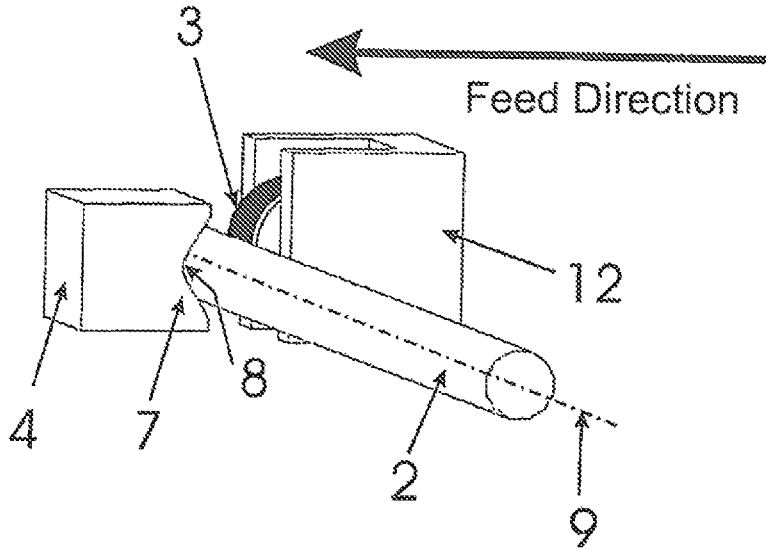
FIG. 2 a pressure roll or profiling tool and a locking element of the device shown in FIG. 1 in a working position, upon introduction of an external thread into a workpiece.
Figure 3:
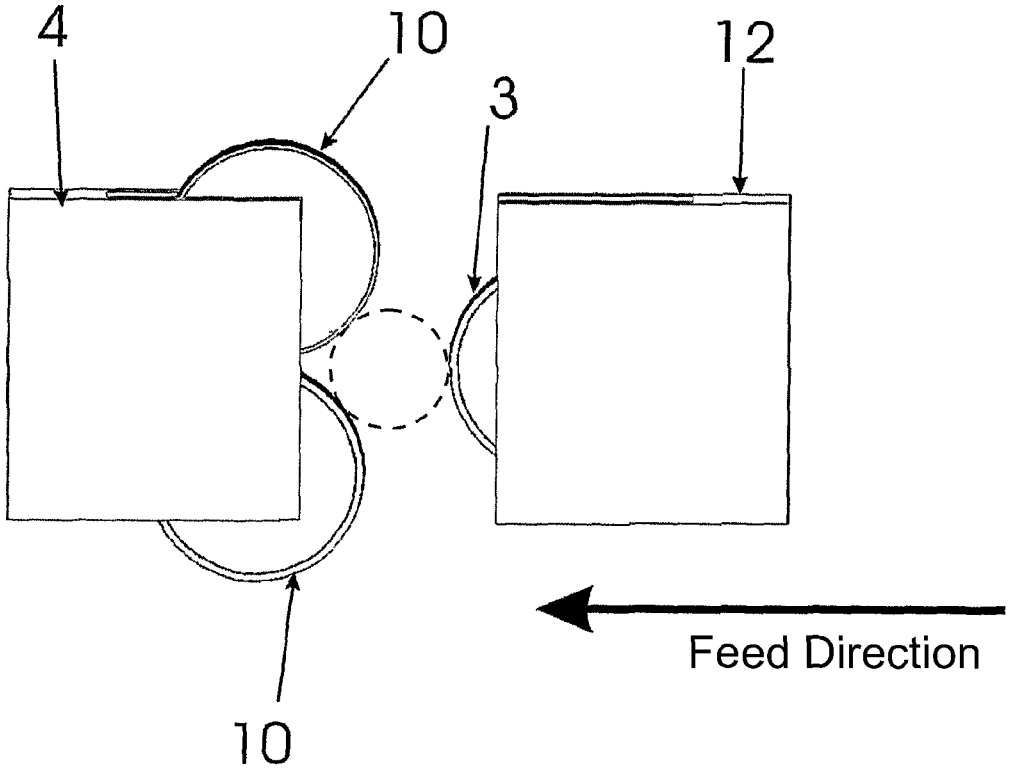
FIG. 3 in an enlarged lateral view, a locking element equipped with two pressure rolls for the device illustrated in FIG. 1.

In the neutral position shown in FIG. 1, workpiece 2 shown in FIG. 2 is introducible from above between profiling tool 3 and locking element 4, allowing the external profile to be introduced to any given position on workpiece 2. To manually transmit the rotary motion when introducing the external profile, threaded rod 6 has a handle 11 to allow the external profile to be thereby introduced in the desired form by a rotary motion of device 1.

To permit adaptation to different workpiece diameters, profiling tool 3 is releasably fixed to device 1 by a mounting support 12. External profiles may hereby be readily introduced to virtually any given workpieces 2 having a circular cross-sectional area, without any reduction in fatigue strength.

The invention claimed is:

1. A portable handheld device for introducing an external profile into a longitudinal workpiece by noncutting shaping, the device comprising:

a profiling tool in the form of a thread-rolling tool configured to form the external profile in the workpiece; and a locking element forming an angle between 35° and 160° on a side facing the profiling tool so as to be configured to lock in place on an outer diameter of the workpiece, the profiling tool being disposed in a force transmission plane opposite the locking element, having a pitchless profile, and being disposable at an adjustable tilt angle so as to be inclined relative to the workpiece as a function of a desired lead angle of the external profile, wherein the workpiece is disposable and removable between the profiling tool and the locking element when the profiling tool and locking element are in a neutral position, wherein the profiling tool and the locking element are configured to execute a feed movement relative to one another such that the neutral position is adjustable, and wherein the locking element includes a profiling configured to engage in interspaces of the introduced external profile so as to improve a transfer of force by the locking element.

2. The device as recited in claim 1, wherein the locking element has at least one pressure roll disposed in the force transmission plane relative to the profiling tool.

3. The device as recited in claim 1, wherein the locking element and the workpiece each include a material having a sliding friction resistance and a surface hardness, wherein the sliding friction resistance and the surface hardness of the locking element are lower than the sliding friction resistance and the surface hardness of the workpiece.

4. The device as recited in claim 1, further comprising a mounting support releasably fixing the profiling tool.

5. The device as recited in claim 1, further comprising a guide rail displaceably mounting the locking element on the device.

6. The device as recited in claim 1, further comprising a threaded sleeve and a threaded rod mounted in the threaded sleeve, the locking element being advanceable by the threaded rod.

7. The device as recited in claim 6, wherein the threaded rod includes an end portion configured as a handle.

8. The device as recited in claim 1, further comprising at least one specific lever arm having a handle configured to manually transmit a rotary motion to the workpiece.

9. The device as recited in claim 1, wherein the device is disposed on an axially inaccessible workpiece.

10. A method for introducing a profile to a longitudinal workpiece, the method comprising:

disposing a locking element opposite from a profiling tool in a force transmission plane, the profiling tool being configured as a thread-rolling tool operable to form the profile in the workpiece and including a pitchless profile and having an adjustable tilt angle so as to be inclined relative to the workpiece as a function of a desired lead angle of the profile, and the locking element forming an angle between 35° and 160° on a side facing the profiling tool so as to be configured to lock in place on an outer diameter of the workpiece and including a profiling configured to engage in interspaces of the introduced external profile so as to improve a transfer of force by the locking element;

introducing the workpiece between the profiling tool and the locking element;

adjusting the tilt angle of the profiling tool in accordance with the desired lead angle of the profile;

advancing the profiling tool and the locking element towards each other until a desired infeed force is transmitted to the workpiece; and introducing the profile by causing a relative rotary motion between the profiling tool and the workpiece.

* * * * *